US005424769A

United States Patent [19]

Sakai et al.

[11] Patent Number: 5,424,769

[45] Date of Patent: Jun. 13, 1995

[54] INK JET RECORDING HEAD

[75] Inventors: Shinri Sakai; Atsushi Kobayashi; Takahiro Naka; Shuji Yonekubo; Toyohiko Mitsuzawa; Satoshi Shinada, all of Nagano, Japan

[73] Assignee: Seiko Epson Corporation, Tokyo, Japan

[21] Appl. No.: 70,903

[22] Filed: Jun. 4, 1993

[30] Foreign Application Priority Data

| | | | |
|---|---|---|---|
| Jun. 5, 1992 | [JP] | Japan | 4-145781 |
| Sep. 16, 1992 | [JP] | Japan | 4-246778 |
| Nov. 12, 1992 | [JP] | Japan | 4-302641 |
| Dec. 16, 1992 | [JP] | Japan | 4-336387 |
| Mar. 19, 1993 | [JP] | Japan | 5-060122 |
| May 28, 1993 | [JP] | Japan | 5-151557 |

[51] Int. Cl.[6] ..... B41J 2/045

[52] U.S. Cl. ..... 347/70

[58] Field of Search ..... 346/140 R; B41J 2/045; 347/68–72

[56] References Cited

FOREIGN PATENT DOCUMENTS 0443628 8/1991 European Pat. Off. .

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

An ink jet recording head having a spacer including a pressure generating chamber, a reservoir, and an ink supply port connecting them, a nozzle plate, hermetically fixed on a first side of the spacer, for generating ink droplets when receiving an ink pressure from the pressure generating chamber, a vibrating plate, hermetically fixed on a second side of the spacer, for pressing the pressure generating chamber, and piezoelectric vibrators for pressing the vibrating plate, wherein the vibrating plate has thin portions each occupying a large area so that the compliance of a regional area closer to the nozzle openings is larger than a regional area closer to the ink supply port.

18 Claims, 12 Drawing Sheets

INK JET RECORDING HEAD

BACKGROUND OF THE INVENTION

The present invention relates to an ink jet recording head of the type in which a pressure generating means applies pressure to ink within a pressure generating chamber, thereby shooting forth ink droplets through nozzle openings. More particularly, the invention relates to the structure of the pressure generating chamber.

One of the known pressure generating chambers communicates, at one end, with an ink tank and is provided with nozzle openings. The pressure generating chamber further includes a pressure generating means provided therein. A heater or a deformable means is used for the pressure generating means. The heater is used for evaporating part of the ink contained pressure generating chamber. The deformable means is realized by forming a diaphragm region within the pressure generating chamber. In this case, a mechanical drive means is provided for pushing the diaphragm region to cause a displacement thereof. With the displacement of the diaphragm region, ink is jetted out of the nozzle openings.

The pressure generating chamber with a piezoelectric vibrator of the longitudinal vibration mode which is brought into contact with the deformable means is known. The ink jet recording head using this type of pressure generating chamber is suitable for color printing, because it is free from the problem of changing ink quality by heat.

In the ink jet recording head operating such that the piezoelectric vibrator of the longitudinal vibration mode resiliently deforms the pressure generating chamber to cause ink to be jetted out of the chamber, the width of the array of nozzle openings of the pressure generating chamber can be remarkably reduced. Accordingly, a high resolution print is possible. When the size of the ink jet recording head is reduced under the constant resolution improvement pressure, the deformable means of the pressure generating chamber must be correspondingly thinned in order to reduce the rigidity of the deformable means. The thin deformable means is fragile.

In the ink jet recording head having the resolution of 300 DPI and having nozzle openings zig-zag arrayed in four lines, the length and the width of the pressure generating chamber are 1 to 2 mm and approximately 200 μm, respectively. The deformable region of the vibrating plate constituting the deformable means is 1 to 3 μm thick, and the region thereof to be displaced by the piezoelectric vibrator is several tens μm. The fore end face of the piezoelectric vibrator for deforming the pressure generating chamber is approximately 500 μm ×200 μm.

For this reason, the vibrating plate includes protruded portions, called islands, which are formed at the locations to be in contact with the piezoelectric vibrators, and longer than the vibrators. The island expands the displacement of the piezoelectric vibrator in the longitudinal direction of the vibrating plate, obtaining a good matching. With the use of the islands, stress concentrates at a part near to the boundary of the island and the flexible thin portion. Eventually, the vibrating plate is broken down by fatigue.

A protruded part, called an island part, is formed in the portion of the vibrating plate where it comes in contact with the piezoelectric vibrator. The island part is longer than the piezoelectric vibrator. A displacement of the piezoelectric vibrator is enlarged in the longitudinal direction. Since the vibrating plate is so shaped, stress is concentrated at the island part and in a boundary part where the deformable thin portion terminates. Accordingly, the vibrating plate is easy to be broken.

The fragility problem of the vibrating plate can be solved by making the thin portion of the vibrating plate as thick as possible. However the thin portion increases the pressure in generating ink droplets. In generating ink droplets, an abrupt increase of the pressure must be avoided; otherwise, misty ink is generated and the ink quality is deteriorated.

SUMMARY OF THE INVENTION

In view of the drawbacks accompanying the conventional recording head, it is an object of the present invention to provide a novel ink jet recording head which improves the print quality and the durability of the vibrating plate.

The above and other objects can be achieved by a provision of an ink jet recording head which, according to the present invention, includes a pressure generating chamber, a nozzle opening and an ink supply passage communicating with the pressure generating chamber, and a pressure generating means for supplying a pressure to the pressure generating chamber, wherein the recording head also includes a thin portion, located at least near the nozzle opening of the pressure generating chamber, which is deformable by ink pressure when ink droplets are discharged forcibly.

With such a construction, if the regional area of the vibrator, which is closer to the ink supply port and under a higher pressure than that applied to the regional area closer to the nozzle opening, has a large rigidity, a high pulsative pressure generated at the time of ink droplets generation can be absorbed by the thin portion closer to the nozzle opening. The pressure absorbed is utilized for elongation of the ink pressure continuation. This leads to effective use of the energy for ink droplets generation.

DESCRIPTION OF THE PREFERRED EMBODIMENTS

The preferred embodiments of the present invention will be described in detail with reference to the accompanying drawings.

Figure 2:
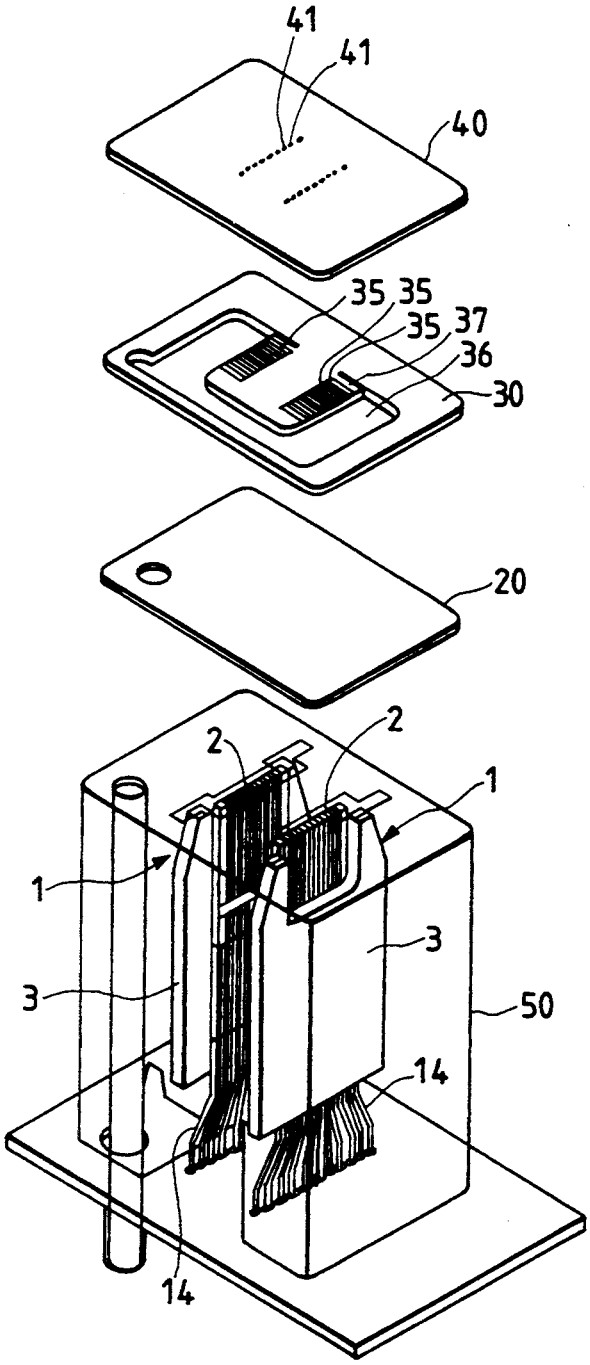
FIG. 2 is an isometric view showing an ink jet recording head according to an embodiment of the present invention.
Figure 3:
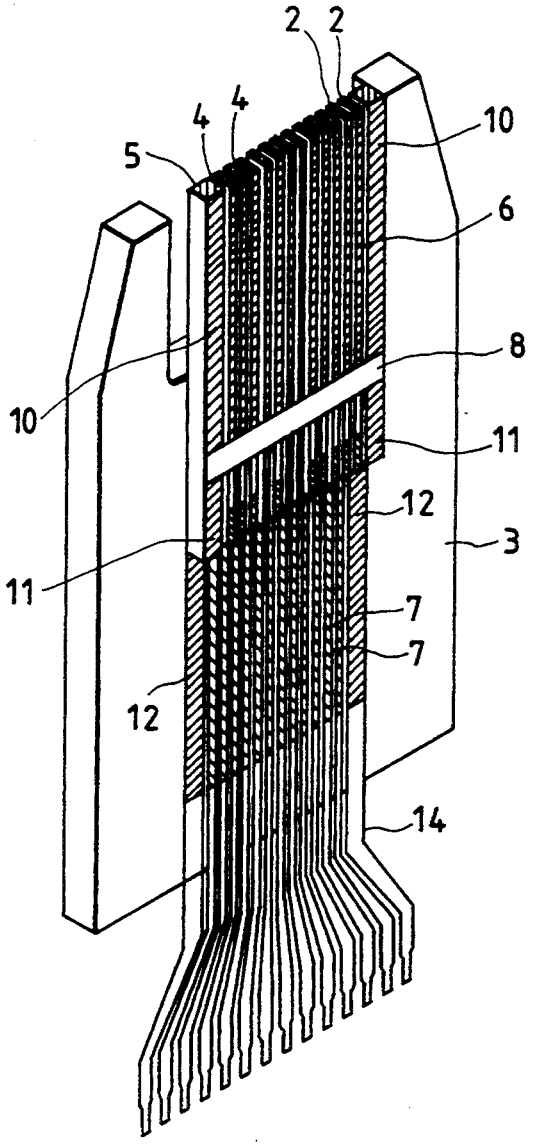
FIG. 3 is a perspective view showing a piezoelectric vibrator unit used in the ink jet recording head of FIG. 2.

Referring to FIG. 2, there is shown an isometric view showing an ink jet recording head of the type using piezoelectric vibrators of the longitudinal vibration mode. In a piezoelectric vibrator unit 1, piezoelectric vibrators 2 of the longitudinal vibration mode, mounted on a transducer unit base 3, are arrayed at the pitch of 280 μm, for example, which is equal to the pitch of the arrayed nozzle openings. 41 (FIG. 3).

Each piezoelectric vibrator 2 is constructed in a manner that a piezoelectric vibrator plate of approximately 500 μm thick is bonded, at one end, to the transducer unit base 3, is cut by a wire saw, for example, to form slits 4 of several mm deep, approximately 150μm wide, and arrayed at the pitches of approximately 280 μm.

Electrodes 5 and 6 are formed on the opposite sides of each piezoelectric vibrator 2, respectively. The electrodes 5 are connected to lead electrodes 7 of the transducer unit base 3. The electrodes 6 are shorted by a connecting member 8, which is then connected to lead electrodes 12, through electrodes 11 formed on paired dummy vibrators 10, which are located on both sides of the group of the piezoelectric vibrators. Those lead electrodes 7 and 12 are connected through a connecting means 14 to a drive circuit.

Figure 1:
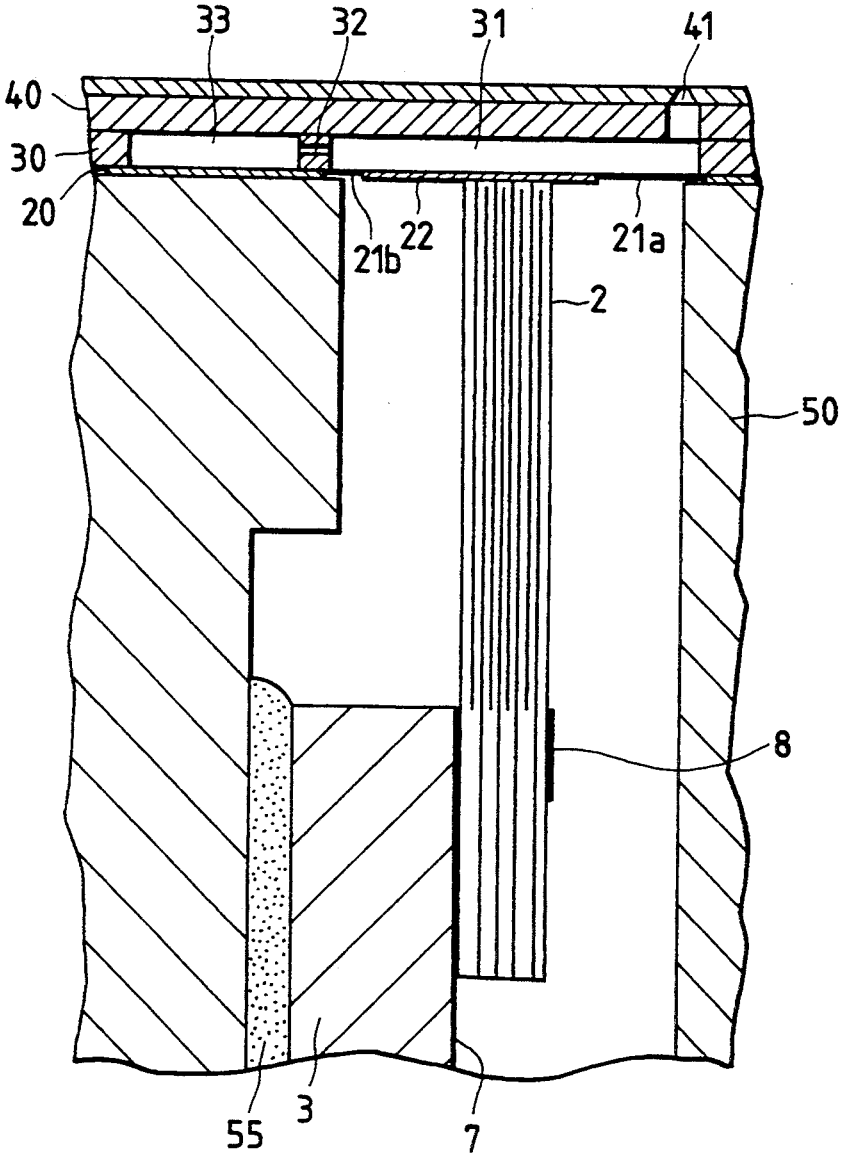
FIG. 1 is a cross sectional view showing a part of an ink jet recording head according to a first embodiment of the present invention.
Figure 4:
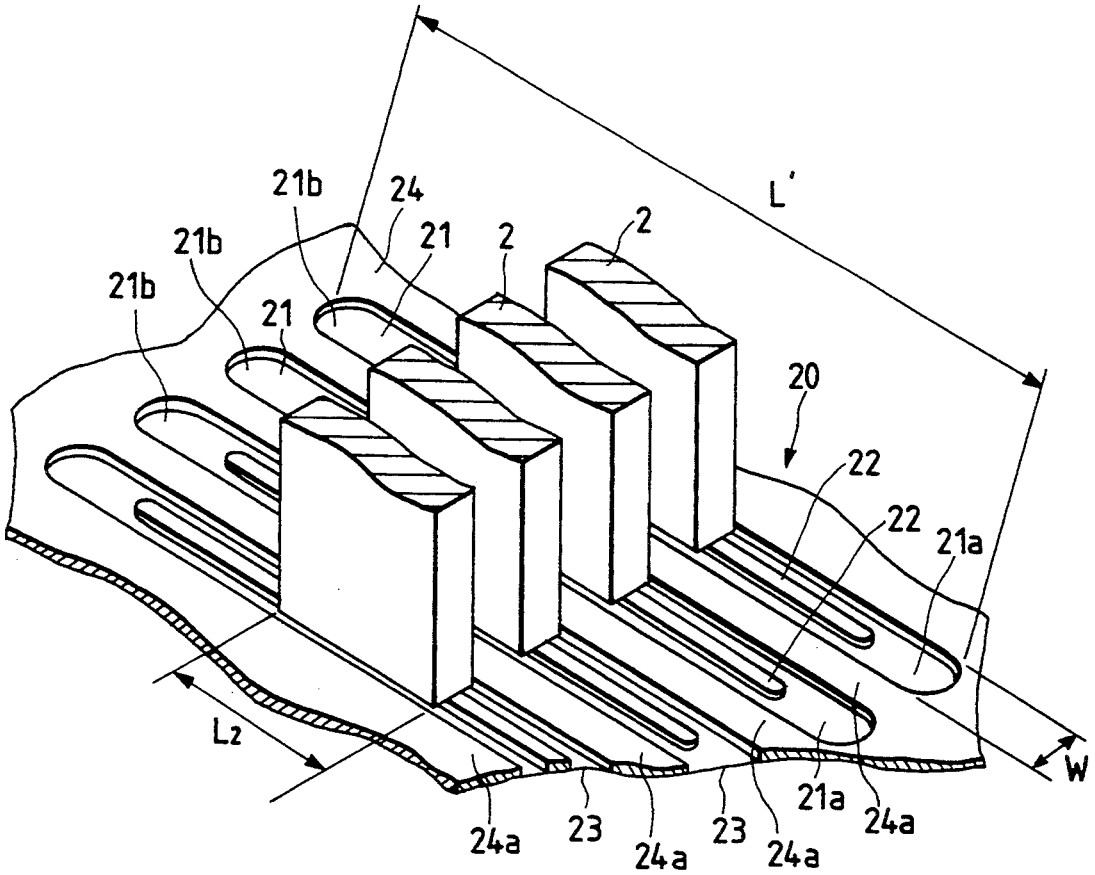
FIG. 4 is a perspective view showing the layout of the piezoelectric vibrators and the vibrating plates in the ink jet recording head.
Figure 5:
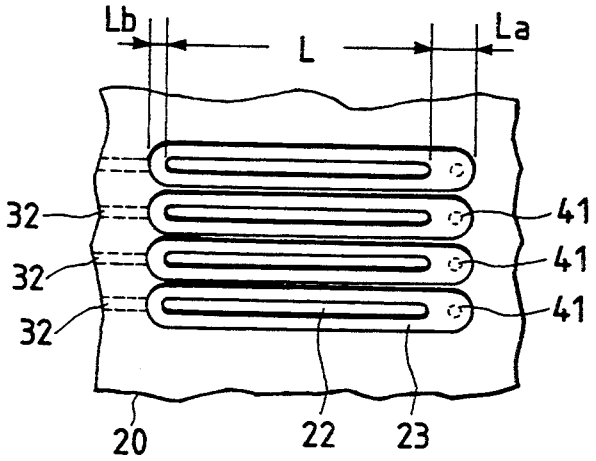
FIG. 5 is a plan view showing the relationship between island portions and thin portions.
Figure 6:
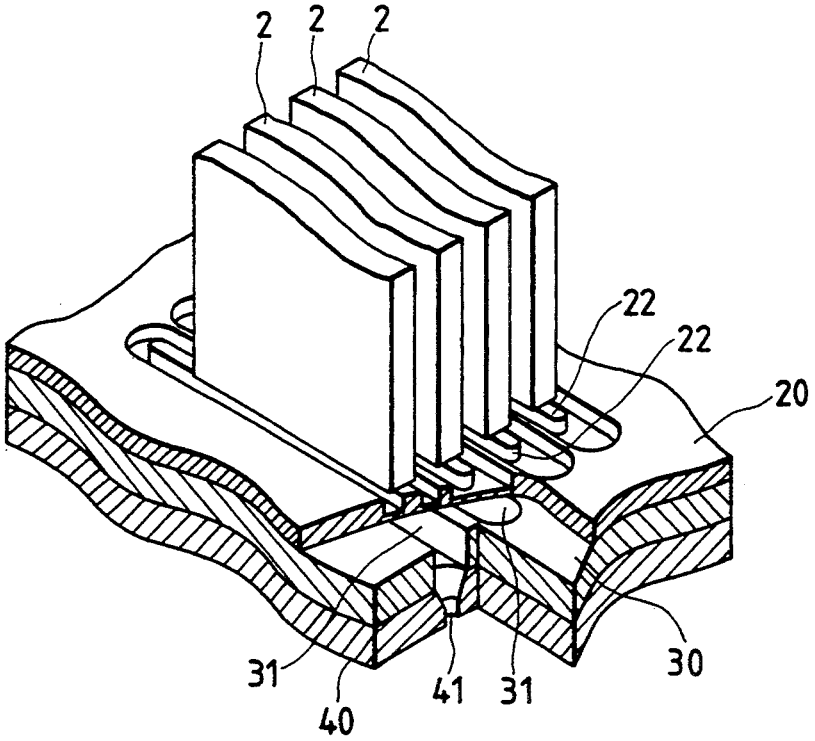
FIG. 6 is a perspective view showing the relationship between flow-path forming members and piezoelectric vibrators.

As shown in FIG. 4, a vibrating plate 20 includes a plural number of elongated, depressed portion 21 arrayed at fixed pitches of approximately 280 μm, which corresponds to the dot density. As shown, both ends of each depressed portion 21 as longitudinally viewed are arcuate. An island 22 occupies the central part of the depressed portion 21. The island 22 as the thick part of the vibrating plate which comes in contact with the top end of the piezoelectric vibrator 2. The depressed portions 21 are integral with a vibrator substrate 24 as a thick portion, with the thin portions 23 each surrounding the island 22. Accordingly, bridge portions 24*a* as thick portions are each located between the adjacent depressed portions 21. The bridge portions 24*a* function to reenforce the depressed portions 21 serving as vibrating areas. The length La of the depressed portion 21 closer to the nozzle openings 41 is longer than the length Lb thereof closer to the ink supply port 32 (FIGS. 1 and 5).

The thickness of the thin and thick portions of the vibrating plate 20 are selected depending on the material used for the vibrating plate 20. When metal, for example, nickel, is used, the thickness of the thick portions of the vibrating plate 20 is selected approximately 25 μm, and the thickness of the thin portions is approximately 1 to 3 μm. The length L of depressed portion 21 is approximately several mm at most, and the width thereof is several hundreds μm. The length L of the island 22 is approximately 1 mm, and its width is several tens μm. The vibrating plate including the thin and thick portions can be manufactured by using a suitable manufacturing technique. For the vibrating plate made of nickel, the electroforming process is used. For the vibrating plate of silicon or glass, the etching technique is used. For the vibrating plate of engineering plastic, the injection process is used. The vibrating plate can also be composed of plural materials instead of a single material.

Returning to FIGS. 1 and 2, a spacer 30 intervenes between a nozzle plate 40 and the vibrating plate 20, whereby forming a pressure generating chamber 31 and the reservoir 33. The spacer 30 includes through holes 35, 36, and 37 in order to form an ink supply port 32, which connects the pressure generating chambers 31 and the reservoir 33.

The vibrating plate 20, the spacer 30, and the nozzle plate 40, after being aligned with one another, are hermetically assembled into a single unit. The islands 22 of the vibrating plate 20 are brought into contact with the top ends of the piezoelectric vibrators 2, and then the transducer unit base 3 is bonded to a body 50 by adhesive 55. The result is to complete an ink jet recording head.

Accordingly, the vibrating plate 20 is fixed in a state that the bridge portions 24*a* of the vibrating plate 20, which are closer to the nozzle openings 41 and the ink supply port 32, are sandwiched by the body 50 and the spacer 30. As a result, the thin portions 21*a* are reenforced by the bridge portions 24*a*.

Figure 7A:
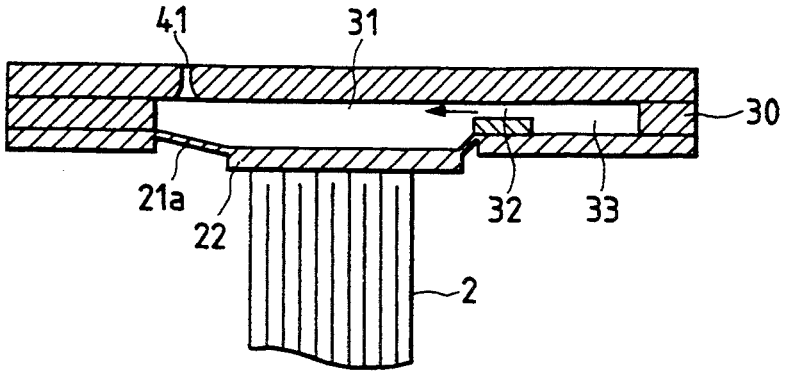
FIGS. 7A to 7C show a set of cross sectional views showing a displacement of the vibrating plate.

In operation, when the piezoelectric vibrators 2 receive a drive signal for contracting the vibrators, the pressure generating chamber 31 is expanded. Under this condition, ink flows from the reservoir 33 into the pressure generating chamber 31 by way of the ink supply port 32 as shown in FIG. 7A.

Then, the piezoelectric vibrators 2 receive again a drive signal for extending the vibrators, the piezoelectric vibrators 2 are expanded to push the islands 22. The islands 22 displace toward the pressure generating chamber 31. Because of this, the pressure generating chamber 31 receives a push over its area as wide as possible, with the rigidity of the islands 22, although the length Lz of the piezoelectric vibrators 2 is shorter than the length L' of the pressure generating chamber 31. Thus, the pressure generating chamber 31 contracts over its broad area.

Figure 7B:
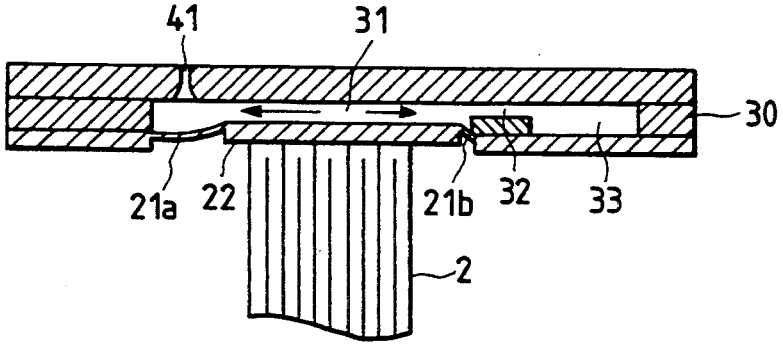

During the compressing process, a high pressure of about 3 atm is generated in the pressure generating chamber 31. Accordingly, the thin portions 21*a* closer to the nozzle openings 41, which have a large compliance, are slightly expanded to absorb part of the pressure in the nozzle openings region, and hence to decrease the peak pressure, while ink present in the nozzle openings is spouted forth in the form of ink droplets, from the nozzle openings 41 toward the recording media, as shown in FIG. 7B. Part of the ink present in the ink supply port 32 flows into the reservoir 33 by way of the ink supply port 32. The thin portions 21*a* closer to the nozzle openings are gradually restored to the original state by the elasticity of the thin portions 21*a* themselves. During the restoring process, the thin portions 21*a* push the ink to assist the ink jetting operation.

Figure 8:
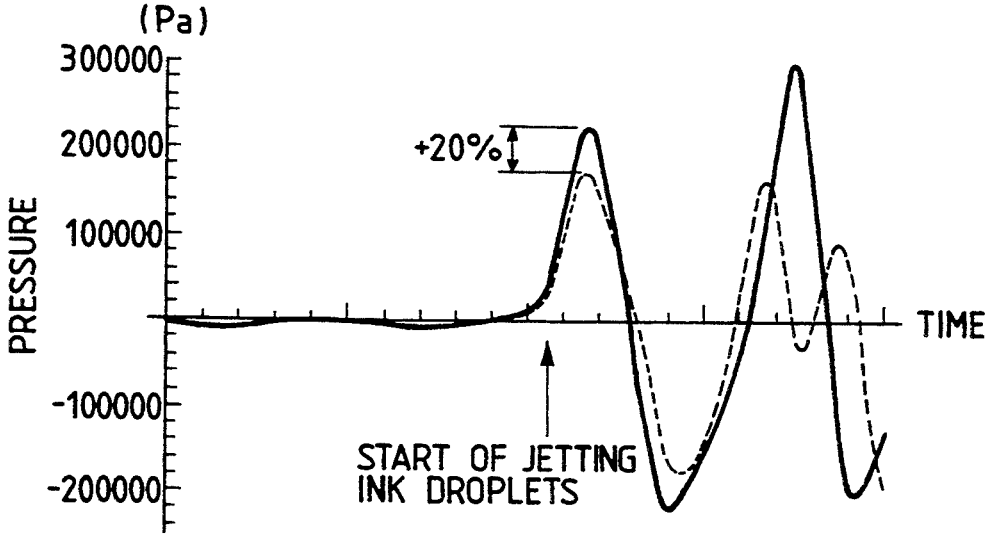
FIG. 8 is a graph showing variations of pressure in the nozzle openings and the ink supply ports when ink droplets are shot forth.

As is well known, the fluid resistance in the ink supply port 32 is selected to be higher than that in the nozzle openings 41, for the purpose of increasing the efficiency of ink droplet generation. Accordingly, a great ink pressure usually acts on the ink supply port 32. As seen from FIG. 8, the pressure in the nozzle openings 41 (as indicated by a dotted line) is different from that in the ink supply port 32 (as indicated by a solid line). The former is higher than the latter by at least 20%.

Figure 7C:
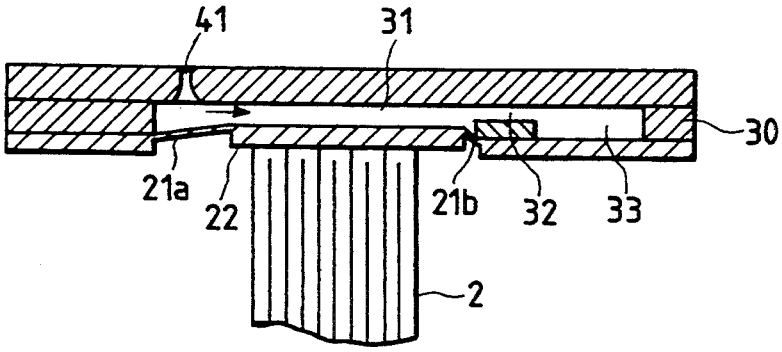

As described above, the thin portions 21*b* closer to the ink supply port 32 are set to be smaller in area than the thin portions 21*a* closer than the nozzle openings 41. Accordingly, the compliance of the former is small. Therefore, the thin portions 21b are deformed not excessively when receiving the high pressure. Hence, their displacement continues following the motion of the piezoelectric vibrators 2 as shown in FIG. 7C. The result is a reduced tendency to create the crack K, which tends to be created in the region closer to the ink supply port 32 (see FIG. 9) in the conventional head.

The thin portions are separated from those thick portions adjacent to the former by bridge portions 24*a* formed as thick portions. Further, since the bridge portions 24*a* are sandwiched by the body 50 and the spacer 30, deformation of the entire vibrating plate, which is caused by the expansion of the piezoelectric vibrators 2, is minimized, so that the vibrating plate is minimally twisted and bent as a whole, causing no cross talk.

(Specific example)

The geometries of the islands and the thin portions of the vibrating plate of an actual ink jet recording head will be described.

An ink jet recording head was manufactured of Which the thin portions are each 1.5 μm thick, the islands are each 15 μm thick, and the pressure generating chamber was 1.2 mm long (as viewed in the longitudinal direction). For several combinations of the length L of each of the islands 22, the length La of the thin portion 21*a* closer to the nozzle openings 41, and the length Lb of the thin portion 21*b* closer to the ink supply port 32, the following items were measured: the compliance CN of the part closer to the nozzle openings 41, the compliance CF in the part closer to the ink supply port 32, print quality, generation of misty ink caused by the cavitation, and the durability of the thin portions 21*b* closer to the ink supply port. The results of the measurement were shown in Table 1. (It was impossible to actually measure the compliances because of the size of the measured object. Accordingly, the compliances were estimated by the finite element method.)

TABLE 1

| L (mm) | La (mm) | Lb (mm) | Compliance: Nozzle opening area CN $m^3/Pa$ | Compliance: Ink supply port area CN $m^3/Pa$ | CN/CF | Misty ink splattering | Strength of the boundary part between the island portion and the thin portion |
|---|---|---|---|---|---|---|---|
| 0.83 | 0.185 | 0.185 | $1.6 \times 10^{-19}$ | $1.6 \times 10^{-19}$ | 1 | Rare | Bad |
| 0.85 | 0.185 | 0.165 | $1.6 \times 10^{-19}$ | $1.3 \times 10^{-19}$ | 1.2 | Rare | Good |
| 0.86 | 0.20 | 0.155 | $1.9 \times 10^{-19}$ | $1.2 \times 10^{-19}$ | 1.6 | Rare | Good |
| 0.87 | 0.165 | 0.165 | $1.3 \times 10^{-19}$ | $1.3 \times 10^{-19}$ | 1 | Generated | Good |
| 0.93 | 0.135 | 0.135 | $1.0 \times 10^{-19}$ | $1.0 \times 10^{-19}$ | 1 | Frequently generated | Good |

Figure 9:
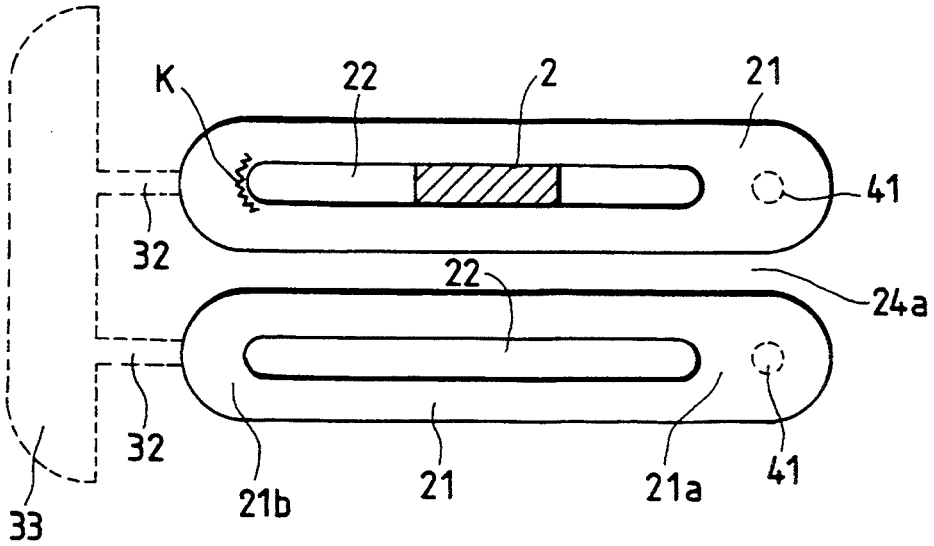
FIG. 9 is an explanatory diagram useful in explaining an example of crack created in the thin portion.
Figure 10:
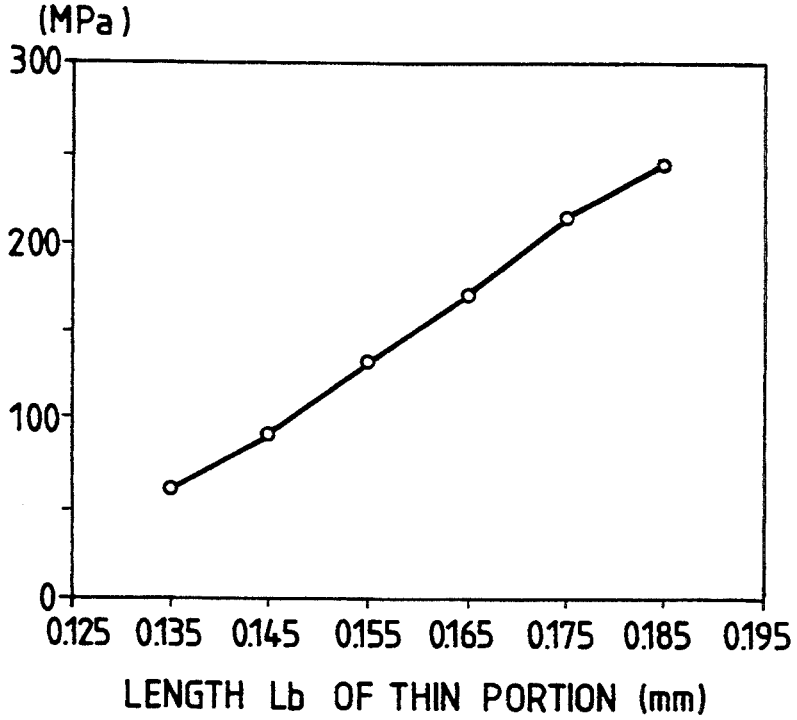
FIG. 10 is a graph showing a variation of a stress generated in the boundary part between the thin portion and the island portion against the length of the thin portion.

From the measurement results, the following fact was confirmed: As the compliance CF in the part closer to the ink supply port 32 becomes large, generation of misty ink is suppressed but the thin portions 21*b* closer to the ink supply port 32 are easily weakened. Further, it was confirmed that as the length Lb of the thin portion 21*b* closer to the ink supply port 32 becomes large, stress applied to the boundary part between the thin portion and the island portion, viz., the part where crack K (FIG. 9) tends to be created, becomes large as shown in FIG. 10.

Where the compliance CN of the part closer to the nozzle openings 41 is substantially equal to the compliance CF in the region closer to the ink supply port 32, the fatigue progress in the thin portions 21*b* is impeded. However, an instantaneous pressure increase cannot be absorbed by the regional part in the vicinity of the nozzle openings 41. As a result, misty ink is generated, leading to deterioration of the print quality.

It was discovered that when the compliance CN is selected to be at least 1.2 times as large as the compliance CF, generation of misty ink is minimized and the durability of the thin portions 21*b* is improved.

Thus, for improving the print quality and the durability of the vibrating plate, it is very effective to increase the compliance CN of the part of the pressure generating chamber 31, which is closer to the nozzle openings 1 in some way, for example, by selecting the length La of the thin portion 21*a* closer to the nozzle openings 41 to be longer than the length Lb of the thin portion 21*b* closer to the ink supply port 32.

Figure 11A:
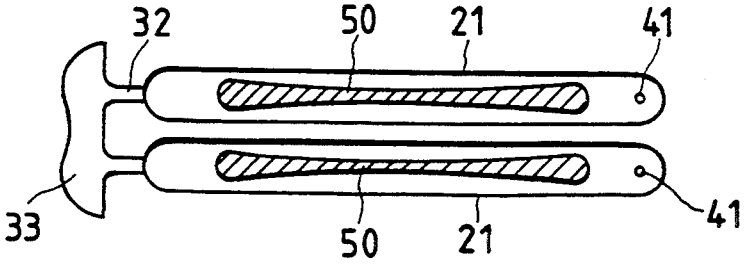
FIG. 11A is an enlarged plan view showing a portion of the vibrating plate, which includes mainly the islands of a first form, according to a second embodiment of the present invention.
Figure 11B:
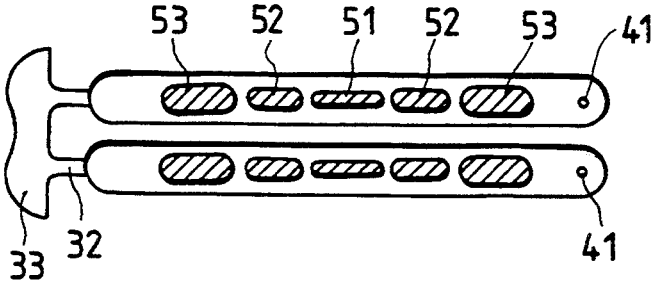
FIG. 11B is an enlarged plan view showing a portion of the vibrating plate, which includes mainly the islands of a second form, according to a second embodiment of the present invention.

In the above-mentioned embodiment, each island is formed in the form of a straight line extended between the nozzle openings side and the ink supply port. The island may be modified as shown in FIGS. 11A and 11B. In the case of FIG. 11A, islands 50 are each narrowed in the central part thereof. In the case of FIG. 11B, islands 51, 52, and 53 of different sizes are separately formed.

Figure 12:
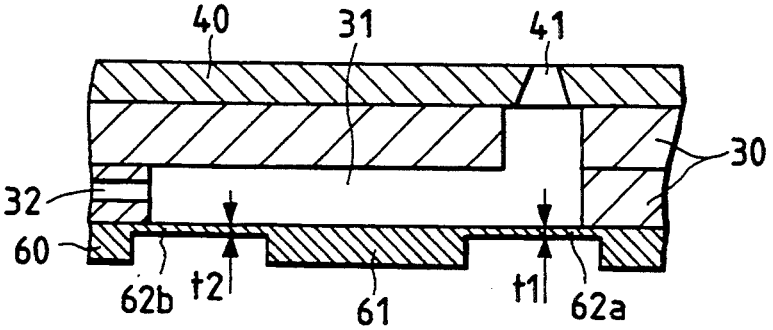
FIG. 12 is a cross sectional view showing a portion of the vibrating plate, which includes mainly the island and its near portion, according to a third embodiment of the present invention.

In the embodiments as mentioned above, the ratio of the compliances CN and CF of the vibrating plate is adjusted by changing the distance between the nozzle opening and the end of the island, which faces the nozzle opening, and the ink supply port and the end of the island, which faces the ink supply port. In this case, the thin portions and the islands are set at the fixed thicknesses. In this embodiment of FIG. 12, the thickness t1 of the thin portion 62*a* closer to the nozzle openings 41 of the island 61, which is contained in the vibrating plate 60, is selected to be thinner than the thickness t2 of the thin portion 62*b* closer to the ink supply port 32. As a result, the compliance CF of the thin portion 62*b* closer to the ink supply port is reduced. Accordingly, the improvement of the print quality and the durability of the vibrating plate can be achieved also in this embodiment. Particularly, the durability of the vibrating plate is further improved since the thickness t2 of the thin portion 62*b* closer to the ink supply port 32 is increased.

Figure 13:
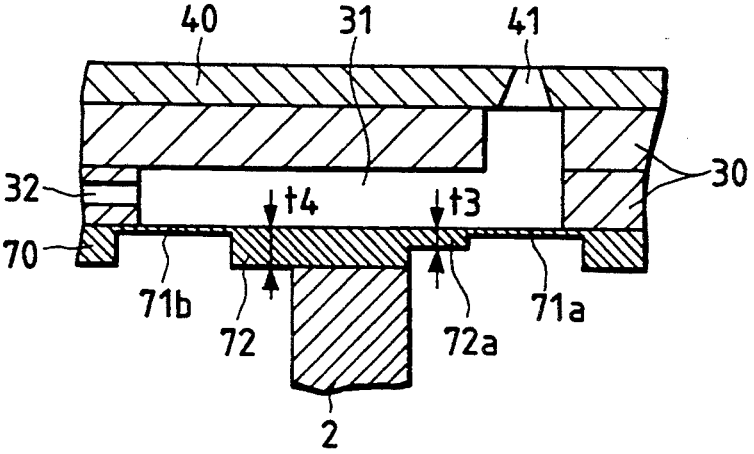
FIG. 13 is a cross sectional view showing a portion of the vibrating plate, which includes mainly the island and its near portion, according to a fourth embodiment of the present invention.

In the embodiment shown in FIG. 13, the thickness of the thin portion 71*a* of the vibrating plate 70, which is closer to the nozzle openings is equal to that of the thin portion 71*b* closer to the ink supply port. The island 72 includes a thinned part 72*a* of which the thickness t3 is thinner than the thickness t4 of the island 72. In this embodiment, the thin portion 71*a* of the vibrating plate 70 and the thinned part 72*a* of the island 72 cooperatively contribute to increase of the compliance CN of the pressure generating chamber, which is closer to the nozzle openings. Further, the acute deformation of the thin portion 71a closer to the nozzle openings is lessened, so that the durability of the vibrating plate 70 is further improved.

Figure 21:
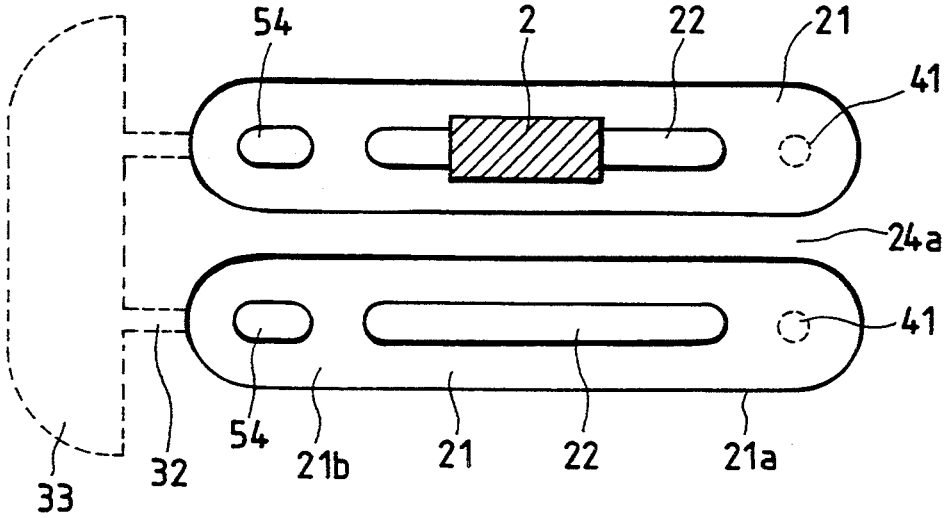
FIG. 21 is a diagram showing another arrangement of islanlds portion and thin portion according to the invention.

FIG. 21 is an explanatory diagram useful in explaining an arrangement which is provided with another island 54 on the depressed portion 21 separate from the islands 22 contacting with the top end of the piezoelectric vibrator 2. This arrangement has as an advantage that the crack K at the thin portion as shown in FIG. 9 does not occur because the islands 54 suppress the change in volume caused by the ink pressure within the pressure generating chamber. Hence, the durability of the vibrating plate is improved.

Figure 14A:
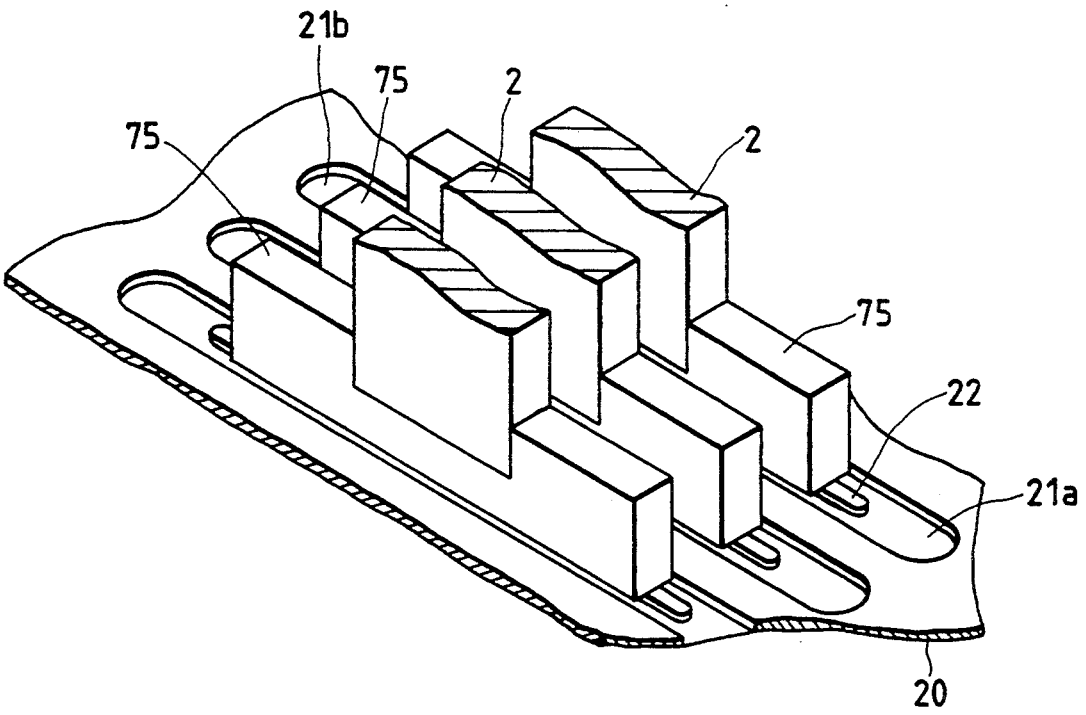
FIG. 14A is a perspective view showing a portion of the vibrating plate, which includes mainly the island and its near portion, according to a fifth embodiment of the present invention.
Figure 14B:
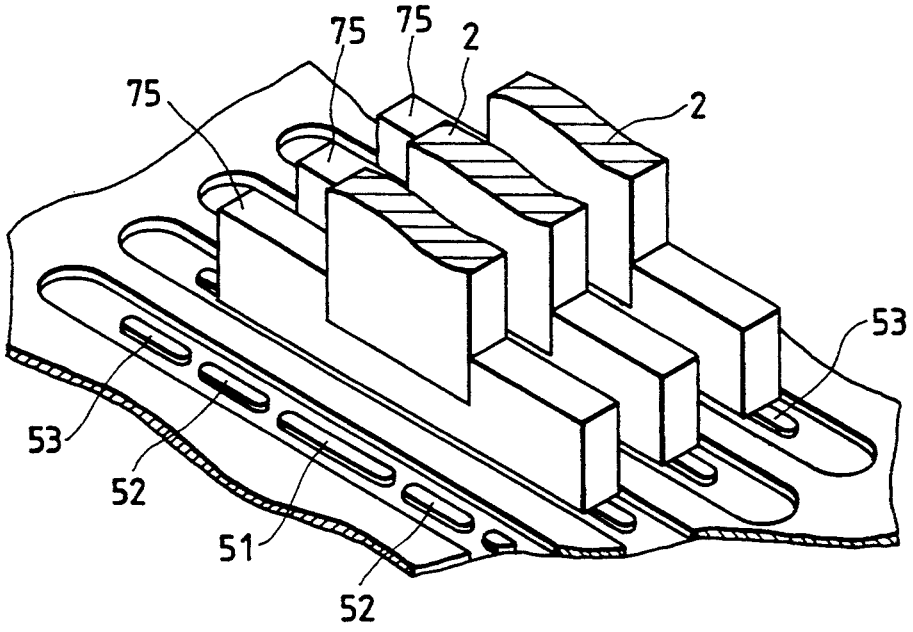
FIG. 14B is a perspective view showing a portion of the vibrating plate according to an arrangement of the vibrating plate shown in FIG. 14A.

In the embodiments as mentioned above, the piezoelectric vibrators 2 are brought into direct contact with the islands 22 of the vibrating plate 20. In the embodiment shown in FIG. 14A, to achieve the improvement of the print quality and the durability of the vibrating plate, transfer members 75 are inserted between the piezoelectric vibrators 2 and the islands 22. As shown, the transfer member 75 is extended more distant than both ends of the piezoelectric vibrator 2, but less distant than both ends of the island 22. The same effect can be achieved by an arrangement shown in FIG. 14B in which the transfer members 75 are inserted between the piezoelectric vibrators 2 and a plurality of separate islands 51, 52 and 53 instead of the single islands 22.

In this embodiment, if the piezoelectric vibrator 2 is sized in accordance with the frequency, matching of the transfer impedances in the vibration transfer path is obtained by the transfer members 75. As a result, the vibration energy can be efficiently transferred to the pressure generating chamber. Further, if the rigidity of the transfer members 75 is selected so that the transfer members 75 are curved upward in the drawing, concentration of stress at the boundary part between the island 22 and the thin portion 21*a* of the vibrating plate, and the islands 22 and the thin portion 21*b* is eased.

Figure 15:
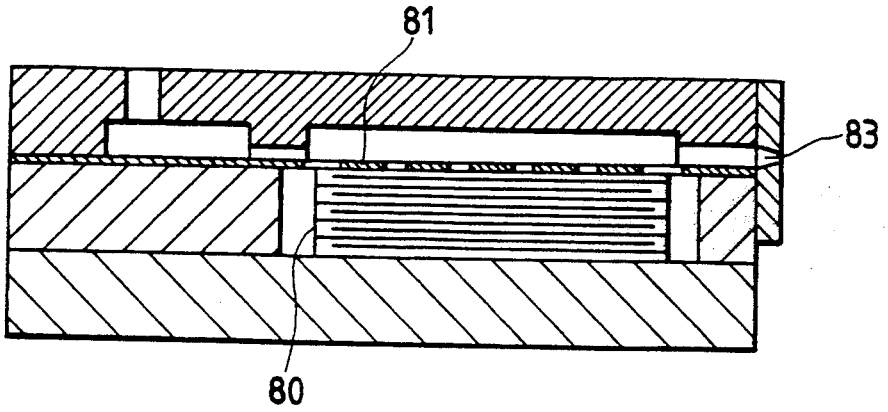
FIG. 15 is a cross sectional view showing a portion of the vibrating plate, which includes mainly the island and its near portion, according to a sixth embodiment of the present invention.

In the embodiment of FIG. 15, the nozzle openings 83 are formed parallel to the vibrating plate 81, which is in contact with the piezoelectric vibrators 80, while in the above-mentioned embodiments, the nozzle openings are located in opposition to the vibrating plate.

Figure 16:
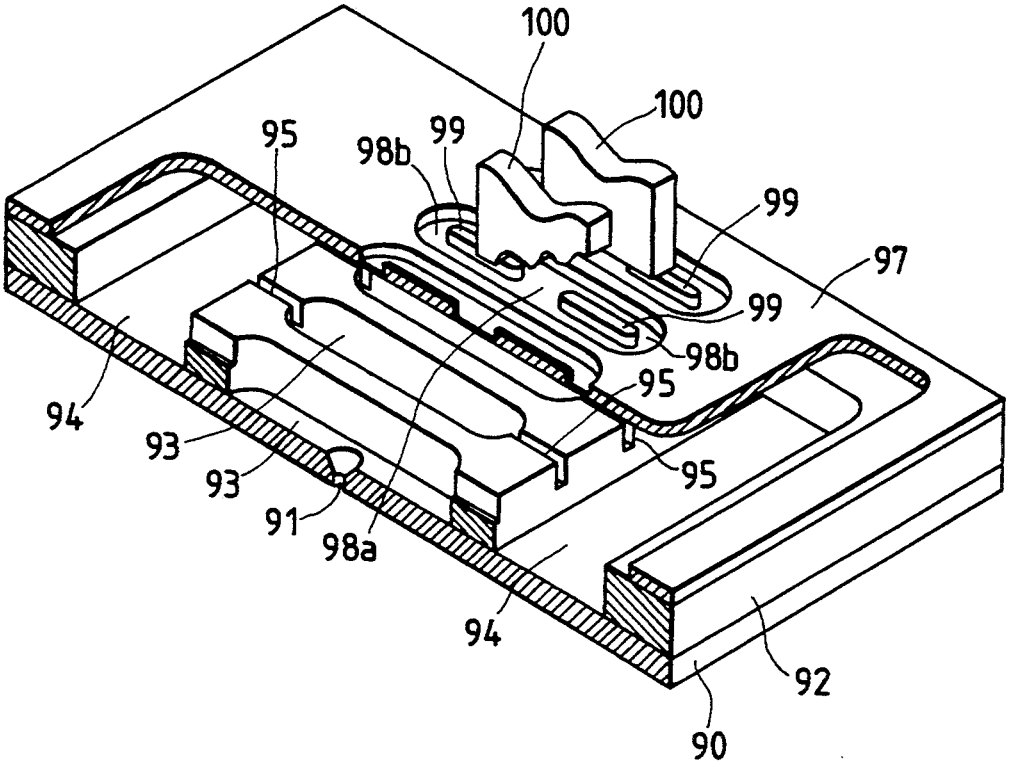
FIG. 16 is a perspective view, partially broken, showing an ink jet recording head according to a seventh embodiment of the present invention.

FIG. 16 is a perspective view, partially broken, showing an ink jet recording head according to a seventh embodiment of the present invention. A nozzle plate 90 contains a plural number of nozzle openings 91. Reference numeral 92 designates a spacer. Within the space enclosed by the spacer 92, there are provided a plural number of cavities 93 serving as pressure generating chambers, enclosed spaces 94, located on both sides of each cavity 93, serving as reservoirs to supply ink to the pressure generating chambers, and grooves 95 connecting the reservoirs 94 to the related pressure generating chamber and serving as ink supply ports. A vibrating plate 97 contains pairs of islands 99 each pair being isolated by thin portions 98*a* facing the nozzle opening and a thin portion 98*b* located closer to the ink supply ports. The thickness and/or area of the thin portion 98*a* facing the nozzle opening 91 is adjusted so that the compliance of which is larger than that of the thin portions 98*b*. In this embodiment, the thin portion 98*a* is adjusted to have a large area. The top end of each piezoelectric vibrator 100 is brought into contact with the paired islands 99, which partially define the related pressure generating chamber.

In operation, a drive signal is applied to the piezoelectric vibrators 100. Each of the piezoelectric vibrators 100 vibrates. A displacement of the vibrating piezoelectric vibrator 100 is transferred to the related pressure generating chamber by way of the paired islands 99, thereby compressing ink contained therewithin. Pressure generated in the pressure generating chamber causes ink present in the vicinity of the nozzle openings 91 to spout forth through the nozzle openings. At this time, some part of the ink deforms the thin portion 98*a* facing the nozzle opening, thereby preventing an excessive increase of the pressure therein, and hence preventing generation of the cavitation. The pressure also acts on the thin portions 98b located closer to the ink supply port. However, deformation of these portions is not excessive because the compliance thereof is preset to such a small value as not to impede the displacement of the piezoelectric vibrator 100, and therefore as to minimize the fatigue.

Figure 17:
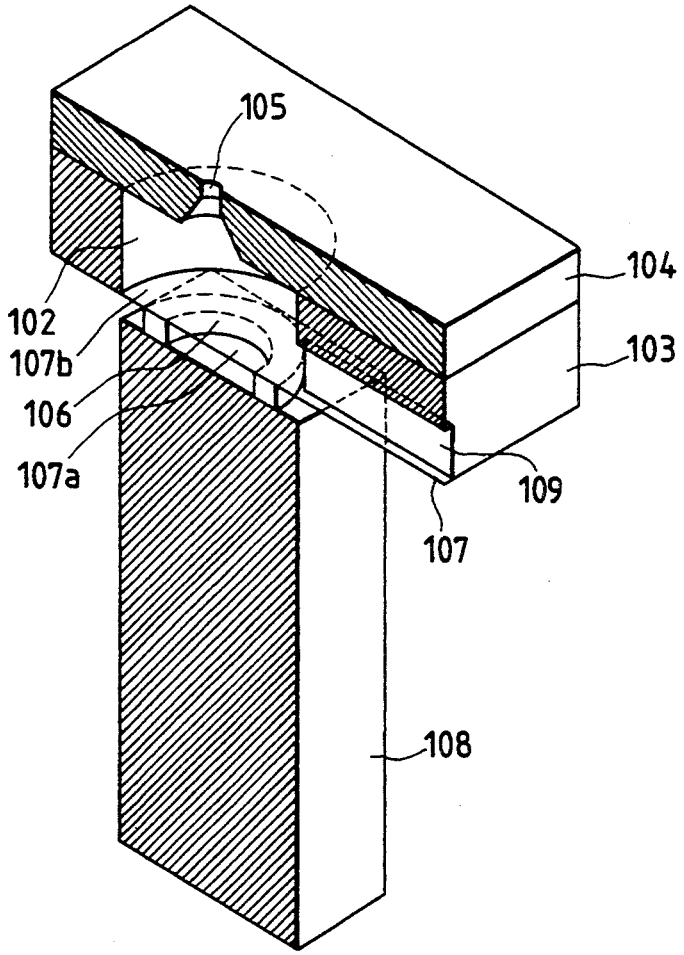
FIG. 17 is a perspective view, partially broken, showing a part of an ink jet recording head according to an eighth embodiment of the present invention.

In an ink jet recording head shown in FIG. 17, a vibrating plate 107 is shaped tubular in cross section, while it is rectangular as viewed in the longitudinal section.

A spacer 103 contains a tubular hole serving as a pressure generating chamber 102. A nozzle plate 104, is located on one of the major sides of the spacer 103 in a state that a nozzle opening 105 formed therein is located at the center of the pressure generating chamber 102. A vibrating plate 107 containing a doughnut-like island 106 is located on the other major side of the spacer 103. A piezoelectric vibrator 108 is brought into contact with the islands 106.

In operation, a drive signal is applied to the piezoelectric vibrator 108. The piezoelectric vibrator 108 presses the vibrating plate 107 to compress the pressure generating chamber 102. The resultant pressure therein causes ink contained therein to spout forth in the form of ink droplets through the nozzle openings 105.

At the same time, the pressure in the vicinity of this resiliently deforms the inner thin portion 107*a* of the vibrating plate, which is located on the inner side of the island 106. The deformation of the inner thin portion 107*a* decreases the pressure therein, causing no cavitation. The outer thin portion 107*b* of the vibrating plate, which is located closer to the ink supply port 109, viz., on the outer side of the island 106, is supported by the island 106 and the spacer 103. Accordingly, the compliance thereof is small, minimizing the deformation by the ink pressure.

Figure 18:
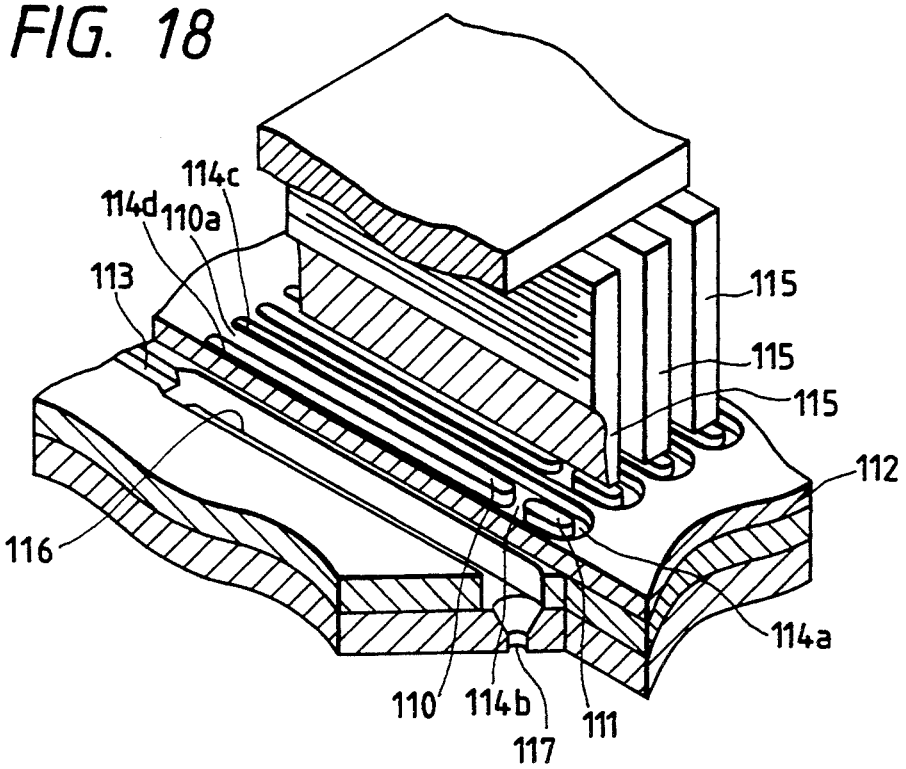
FIG. 18 is a perspective view showing a key part of an ink jet recording head according to a ninth embodiment of the present invention.

FIG. 18 is a perspective view showing a key part of an ink jet recording head according to a ninth embodiment of the present invention. Reference numerals 110 and 111 designate first and second islands contained in a vibrating plate 112. The base end of the island 110, which is closer to an ink supply port 113, is continuous to the thick portion of the vibrating plate. The island 110, except the base end thereof, is resiliently supported by thin portions 114*b*, 114*c*, and 114*d*. The two islands 110 and 111 are in contact with the end of the piezoelectric vibrator 115. With this, a pressure generating chamber 116 is compressible.

In this embodiment, a displacement of the piezoelectric vibrator 115 is transferred to the islands 110 and 111. The island 110, acting as a cantilever, cooperates with the resilient thin portions to compress the pressure generating chamber 116. The island 111 resiliently deforms the thin part 114*a* to compress the pressure generating chamber 116. The ink pressure in the compressed pressure generating chamber 116 causes the ink present in the vicinity of a nozzle opening 117 to spout forth in the form of ink droplets through the nozzle opening 117. The ink also resiliently deforms the thin part 114*a* near the island 111, preventing an excessive increase of the ink pressure. The ink pressure present at a location near the ink supply port 113 acts to displace the island 110, but it only slightly deforms the island because the end 110*a* of the island 110 is continuous to the thick portion of the vibrating plate 112.

Accordingly, the piezoelectric vibrator 115 can smoothly vibrate, and the thin portions 114*c* and 114*d* located closer to the ink supply port 113 will not be broken down by fatigue.

In the embodiments as mentioned above, nozzle openings are serially arrayed at a print density of 90 dpi. When the nozzle openings are arrayed at a higher density, e.g., 150 dpi, the gap between the adjacent pressure generating chambers is extremely narrow.

Figure 19:
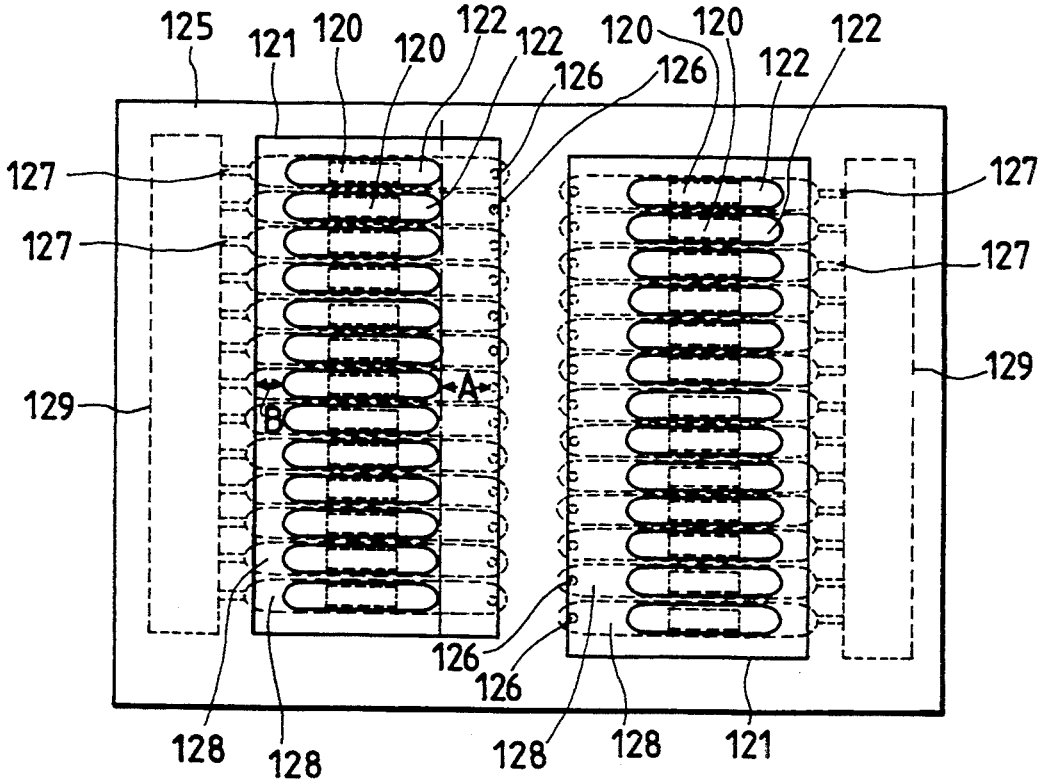
FIG. 19 is a plan view showing a plan view showing the structure of a vibrating plate of an ink jet recording head according to a tenth embodiment of the present invention.

In the recording head of such a high print density, it is difficult to form the bridges for separately defining the thin portions. To cope with this, in this embodiment, the areas containing the arrays of piezoelectric vibrators 120 therein are formed as thin portions 121, as shown in FIG. 19. Islands 122 are formed in alignment with the portions opposed to piezoelectric vibrators 120, viz., pressure generating chambers 128. A compliance CN of a first area A is selected to be at least 1.2 times as high as a compliance CF of the thin portion of a second area B. The first area A ranges from the first ends of the islands .122 to the part of thick portion 125 surrounding the thin portions 121 where adjoins nozzle openings 126. The area B ranges from the second ends of the islands 122 and ink supply ports 127. The ratio of the compliances CN and CF is gained by properly selecting the length and thickness of those areas A and B. The result is to remarkably reduce the fatigue in the thin portions closer to the ink supply ports. Reference numeral 129 designates reservoirs.

Figure 20A:
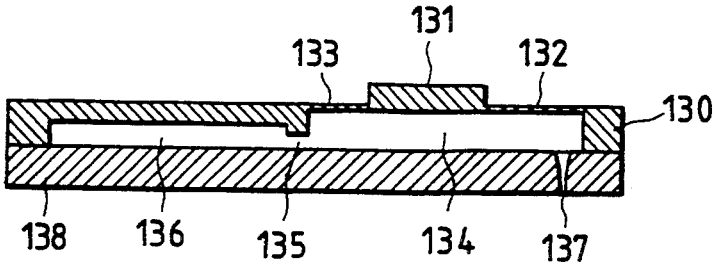
FIGS. 20A to 20C are cross sectional views showing exemplars of ink jet recording heads to which the present invention is applicable.

In the embodiments as mentioned above, different members, such as the nozzle plate, the spacer, and the vibrating plate, are assembled to separately define the pressure generating chambers. In the instance of FIG. 20A, by etching a silicon wafer 130 from both sides thereof, an island 131, and thin portions 132 and 133, located on both sides of the island 131, are formed in one of the sides of the silicon wafer 130. The thin portions 132 and 133 are respectively located closer to a nozzle opening 137 and an ink supply port 135. The other side of the silicon wafer 130 is etched away to form incurved portions for forming a pressure generating chamber 134, the ink supply port 135, and a reservoir 136. A nozzle plate 138 with a nozzle opening 137 formed therein is applied over the other side of the silicon wafer 130 thus shaped. In this case, the length and/or thickness of the thin portion 132 closer to the nozzle opening is adjusted in relation to the thin portion 133 so that the compliance of the thin portion 132 is large.

Figure 20B:
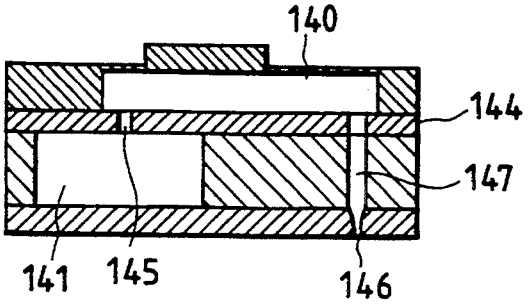

In the embodiments as mentioned above, the pressure generating chamber is flush with the reservoir. In another instance of FIG. 20B, a pressure generating chamber 140 is located above a reservoir 141 in a state that both of them partially overlap and are partitioned by a partitioning plate 144. The pressure generating chamber 140 communicates with the reservoir 141 through a through-hole 145 serving also as an ink supply port. A flow path 147 connects the nozzle opening 146 to the pressure generating chamber 140.

Figure 20C:
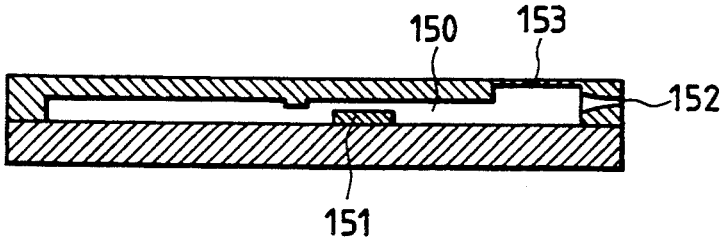

The piezoelectric vibrators are used for generating the ink-droplets causing pressure in the pressure generating chamber. A bubble ink jet recording head is illustrated in FIG. 20C. In this recording head, a resistor wire 151 is disposed within a pressure generating chamber 50. Ink is bubbled by Joule heat generated by the resistor wire 151 when it receives a drive signal, and is shot forth in the form of ink droplets.

When the present invention is applied to this type of recording head, a thin portion 153 is formed between the heat generating portion and the nozzle opening. The thin portion 153 absorbs an extremely high, pulsative pressure generated when ink bubbles are generated. By this action, the speed of the ink droplets when they are shot forth is reduced, thereby preventing the print paper from being blotted with ink. Additionally, the pressure continuation is elongated, effectively spouting forth the ink droplets. The pressure decrease contributes to an increase of the lifetime of the heater and suppresses an undesired increase of ink temperature, thereby preventing deterioration of ink.

As seen from the foregoing description, the ink jet recording head according to the present invention includes a pressure generating chamber, a nozzle opening and an ink supply passage communicating with the pressure generating chamber, and a pressure generating means for supplying a pressure to the pressure generating chamber, wherein the recording head also includes a thin portion, located at least near the nozzle opening of the pressure generating chamber, which is deformable by ink pressure when ink droplets are discharged forcibly. If the regional area of the vibrator, which is closer to the ink supply port and under a higher pressure than that applied to the regional area closer to the nozzle opening, has a large rigidity, a high pulsative pressure generated at the time of ink droplets generation can be absorbed by the thin portion closer to the nozzle opening. The pressure absorbed is utilized for elongation of the ink pressure continuation. The elongated ink pressure continuation minimizes the reduction of the energy for ink droplets generation, which arises from the miniaturization of the piezoelectric vibrator resulting from increase of the print density. Further, it reenforces the vibrating plate at the portion thereof closer to the ink supply port, thereby preventing the vibrating plate from being broken down by fatigue.

What is claimed is:

1. An ink jet recording head, comprising:
a nozzle opening for jetting ink droplets;
a pressure generating chamber, having a plurality of walls;
an ink supply passage communicating with said nozzle opening through said pressure generating chamber; and
pressure generating means for supplying a pressure to said pressure generating chamber;
wherein one of said plurality of walls of said pressure generating chamber has a first thin portion of a first compliance formed therein in close proximity to said nozzle opening, and a second thin portion of a second compliance formed in said one of said plurality of walls of said pressure generating chamber in close proximity to said ink supply passage, said first compliance being larger than said second compliance.

2. An ink jet recording head, comprising:
a nozzle opening for jetting ink droplets;
a pressure generating chamber having a plurality of walls;
an ink supply passage communicating with said nozzle opening through said pressure generating chamber;
pressure generating means for supplying a pressure to said pressure generating chamber;
wherein one of said plurality of walls of said pressure generating chamber has a first thin portion of a first compliance formed therein in close proximity to said nozzle opening, and a second thin portion of a second compliance formed in said one of said plurality of walls of said pressure generating chamber in close proximity to said ink supply passage; said first compliance being at least 1.2 times larger than said second compliance.

3. The ink jet recording head of claim 1, wherein said first compliance is determined by adjusting a surface area of said first thin portion and said second compliance is determined by adjusting a surface area of said second thin portion.

4. The ink jet recording head of claim 1, wherein said first compliance is determined by adjusting a thickness of said first thin portion and said second compliance is determined by adjusting a thickness of said second thin portion.

5. An ink jet recording head comprising:
a nozzle opening for jetting ink droplets;
a pressure generating chamber having a plurality of walls;
an ink supply passage communicating with said nozzle opening through said pressure generating chamber;
pressure generating means for supplying a pressure to said pressure generating chamber;
wherein one of said plurality of walls of said pressure generating chamber has a first thin portion of a first compliance formed therein in close proximity to said nozzle opening and facing said nozzle opening, and a second thin portion of a second compliance formed in said one of said plurality of walls of said pressure generating chamber in close proximity to said ink supply passage; said first compliance being larger than said second compliance.

6. An ink jet recording head, comprising:
a nozzle opening for jetting ink droplets;
a pressure generating chamber;
an ink supply passage communicating with said nozzle opening through said pressure generating chamber;
a vibrating plate forming one wall of said pressure generating chamber, said vibrating plate comprising a first thin portion close to said nozzle opening having a first compliance and a second thin portion close to said ink supply passage having a second compliance, wherein said first compliance is greater than said second compliance; and
a piezoelectric vibrator having a longitudinal vibration mode for applying a pressure to said pressure generating chamber, said piezoelectric vibrator connecting to said vibrating plate.

7. An ink jet recording head comprising:
a nozzle opening for jetting ink droplets;
a pressure generating chamber;
an ink supply passage communicating with said nozzle opening through Said pressure generating chamber;
a vibrating plate forming one wall of said pressure generating chamber, said vibrating plate comprising a first thin portion close to said nozzle opening having a first compliance and a second thin portion close to said ink supply passage having a second compliance, wherein said first compliance is at least 1.2 times as large as said second compliance; and
a piezoelectric vibrator having a longitudinal vibration mode for applying a pressure to said pressure generating chamber, said piezoelectric vibrator connecting to said vibrating plate.

8. The ink jet recording head of claims 6, wherein said first compliance is determined by adjusting a surface area of said first thin portion and second compliance is determined by adjusting a surface area of said second thin portion.

9. The ink jet recording head of claim 6, wherein said first compliance is determined by adjusting a thickness of said first thin portion and said second compliance is determined by adjusting a thickness of said second thin portion.

10. An ink jet recording head comprising:

a nozzle opening for jetting ink droplets;

a pressure generating chamber;

an ink supply passage communicating with said nozzle opening through said pressure generating chamber;

a vibrating plate forming one wall of said pressure generating chamber, said vibrating plate comprising a first thin portion close to said nozzle opening and facing said nozzle opening and having a first compliance, and a second thin portion having a second compliance close to said ink supply passage, said first compliance being larger than said second compliance; and a piezoelectric vibrator having a longitudinal vibration mode for applying a pressure to said pressure generating chamber, said piezoelectric vibrator connecting to said vibrating plate.

11. The ink jet recording head of claim 6, wherein said vibrating plate comprises at least one island member which is surrounded by said thin portion, said at least one island member and said piezoelectric vibrator are connected to each other.

12. An ink jet recording head comprising:

a nozzle opening for jetting ink droplets;

a pressure generating chamber;

an ink supply passage communicating with said nozzle opening through said pressure generating chamber;

a vibrating plate forming one wall of said pressure generating chamber, said vibrating plate comprising a first thin portion close to said nozzle opening having a first compliance and a second thin portion having a second compliance close to said ink supply passage, said first compliance being larger than said second compliance; and a piezoelectric vibrator having a longitudinal vibration mode for applying a pressure to said pressure generating chamber, said piezoelectric vibrator connecting to said vibrating plate;

wherein said vibrating plate comprises at least one island member which is surrounded by said thin portion, said island member and said piezoelectric vibrator are connected to each other; and wherein said first compliance and said second compliance are adjusted by lengths of said thin portion extending from an end of said island member to said ink supply passage and from an end of said island member to said nozzle opening.

13. The ink jet recording head of claim 11 or 12, wherein said first compliance and said second compliance are adjusted by a thickness of said island member.

14. An ink jet recording head comprising:

a nozzle opening for jetting ink droplets;

a pressure generating chamber;

an ink supply passage communicating with said nozzle opening through said pressure generating chamber;

a vibrating plate forming one wall of said pressure generating chamber, said vibrating plate comprising a first thin portion close to said nozzle opening having a first compliance and a second thin portion having a second compliance closer to said ink supply passage, said first compliance being larger than said second compliance; and a piezoelectric vibrator having a longitudinal vibration mode for applying a pressure to said pressure generating chamber, said piezoelectric vibrator connecting to said vibrating plate;

wherein said vibrating plate comprises at least one island member which is surrounded by said first thin portion, said island member and said piezoelectric vibrator are connected to each other; and wherein said island member is divided into plural sections along a direction connecting between said ink supply passage and said nozzle opening.

15. An ink jet recording head comprising:

a nozzle opening for jetting ink droplets;

a pressure generating chamber;

an ink supply passage communicating with said nozzle opening through said pressure generating chamber;

a vibrating plate forming one wall of said pressure generating chamber, said vibrating plate comprising a first thin portion close to said nozzle opening having a first compliance and a second thin have a second compliance closer to said ink supply passage, said first compliance being larger than said second compliance; and a piezoelectric vibrator having a longitudinal vibration mode for applying a pressure to said pressure generating chamber, said piezoelectric vibrator connecting to said vibrating plate;

wherein said vibrating plate comprises at least one island member which is surrounded by said first thin portion, said island member and said piezoelectric vibrator are connected to each other; and wherein said piezoelectric member and said island member are connected to each other through a connecting member which is larger than said piezoelectric vibrator but smaller than said island member with respect to a longitudinal dimension of said island member.

16. An ink jet recording head, comprising:

a nozzle opening for jetting ink droplets;

a pressure generating chamber;

an ink supply passage communicating with said nozzle opening through said pressure generating chamber;

a vibrating plate forming one wall of said pressure generating chamber, said vibrating plate comprising an island member divided into plural sections along a direction connecting between said ink supply passage and said nozzle opening and a thin portion, said island member being surrounded by said thin portion; and a piezoelectric vibrator connecting to said vibrating plate for supplying pressure to said pressure generating chamber, said piezoelectric vibrator contacting at least two sections of said island member.

17. The ink jet recording head claim 16, wherein said island member is wide at a part close to said nozzle opening and said ink supply passage and narrow at a center part thereof.

18. The ink jet recording head of claim 16, wherein the thin portion is formed around said island member against said nozzle opening.

* * * * *